United States Patent [19]

O'Connell

[11] 4,277,897

[45] Jul. 14, 1981

[54] DANCE/GYMNASTIC FOOTLET

[76] Inventor: Betty O'Connell, 2122 White Chapel, Toledo, Ohio 43614

[21] Appl. No.: 80,386

[22] Filed: Oct. 1, 1979

[51] Int. Cl.[3] ..... A43B 3/00; A43B 3/18

[52] U.S. Cl. ..... 36/106; 36/7.2; 36/113

[58] Field of Search ..... 36/9 R, 7.2, 106, 113, 36/114

[56] References Cited

U.S. PATENT DOCUMENTS

| | | | |
|---|---|---|---|
| 2,237,652 | 4/1941 | Capezio | 36/113 |
| 3,324,579 | 6/1967 | Steininger | 36/7.2 |
| 3,793,748 | 2/1974 | Pursley | 36/9 R |
| 4,069,599 | 1/1978 | Alegria | 36/106 |

*Primary Examiner*—Patrick D. Lawson

*Attorney, Agent, or Firm*—Wilson, Fraser, Barker & Clemens

[57] ABSTRACT

This invention relates to a gymnastic footlet including a toe section for receiving the forward end of the foot and a securing strap attached to the toe section for wrapping around heel of the foot. The toe section includes a bottom portion extending over only the ball area on the bottom of the foot to provide the dancer or gymnast with an area of relatively low friction between the foot and the support surface. The heel of the foot is uncovered to provide the dancer or gymnast with an area of relatively high friction between the foot and the support surface. The footlet leaves uncovered most of the foot and the ankle area to free the wearer from any possible encumbrance and to expose the natural elegance thereof.

2 Claims, 3 Drawing Figures

DANCE/GYMNASTIC FOOTLET

BACKGROUND OF THE INVENTION

Dance or gymnastic routines typically include a wide variety of steps. Some steps require the feet to slide across the support mat, floor or dance surface, while other steps require the feet to grip the support surface. For example, turns and spins, which are typically performed on the ball of the foot, or other traveling steps such as a glissade, all require that the feet slide across the dance surface. On the other hand, a balancing step such as an arabesque, or a jumping step, require the feet to grip the floor. Thus, depending on the step a dancer is executing, it is desirous to have the foot either slide across or grip the floor which inherently is impossible when the dancer is bare-footed or wears a full stocking or shoe.

Dancing or gymnastic shoes are often utilized by dancers or gymnasts to assist in the execution of various dance steps or gymnastic routines. Typical examples of such dancing shoes can be found in U.S. Pat. No. 1,520,708 issued to Goldstein et al and U.S. Pat. No. 1,745,054 issued to Selva. These references pertain to a full-sole ballet slipper which will not provide the wearer with, in effect, two areas of different friction properties to facilitate the various steps, etc.

BRIEF SUMMARY OF THE INVENTION

The present invention is a gymnastic footlet having a bottom portion which covers the ball area on the bottom of the foot while leaving the heel of the foot uncovered. This type of construction results in an area of relatively low friction between the ball area of the foot and the dance surface while the heel remains uncovered to provide an area of relatively high friction. Thus, the gymnast or dancer can utilize the ball area of the feet to execute spins, turns, and other traveling steps while using the heel area for steps which require the foot to grip the floor.

Specifically, the gymnastic footlet comprises a toe section having a closed front end and an open rear end for receiving the forward end of the foot. The toe section includes a bottom portion extending rearwardly from the front end for covering the ball area on the bottom of the foot and a top portion extending over the toes with the edges of the top and bottom portions joined along their lateral sides. The footlet also includes a securing strap for wrapping around the heel of the foot for holding the toe section on the foot. The securing strap has one end connected to one side of the toe section and has the other end connected to the opposite side of the toe section.

It is an object of the present invention to provide a footlet for gymnasts or dancers which covers the ball area on the bottom of the foot while leaving the heel of the foot uncovered.

It is a further object of the invention to provide a footlet for gymnasts which provides, in effect, a first area over the ball of the foot having one frictional characteristic different from that of the remainder of the uncovered foot with the characteristic of the first area being selected by choice of the material used to cover the ball of the foot so that an area of higher, lower, or similar characteristic can be provided, depending upon the likes and demands of the wearer.

The above, as well as other objects and advantages of the invention, will become readily apparent to one skilled in the art from the following detailed description of a preferred embodiment of the invention when considered in light of the accompanying drawings.

DETAILED DESCRIPTION OF A PREFERRED EMBODIMENT

Figure 1:
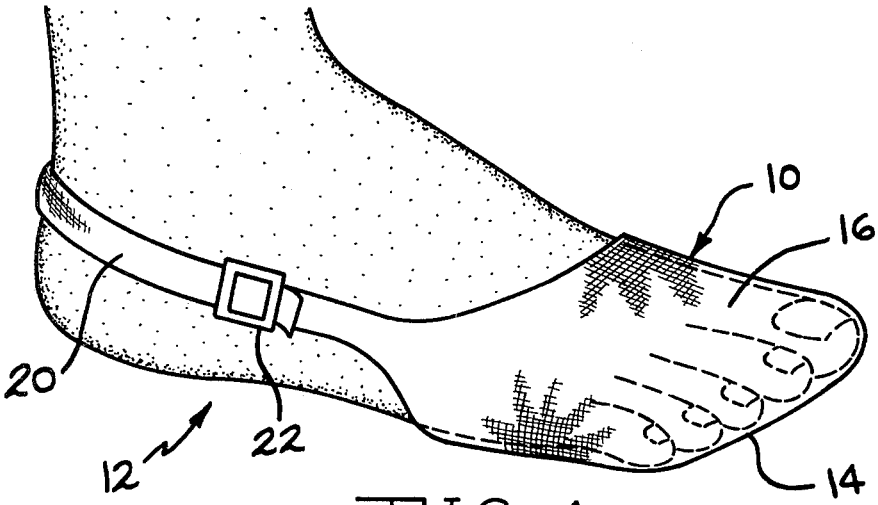
FIG. 1 is a perspective view of a right foot fitted with a gymnastic footlet according to the present invention.
Figure 2:
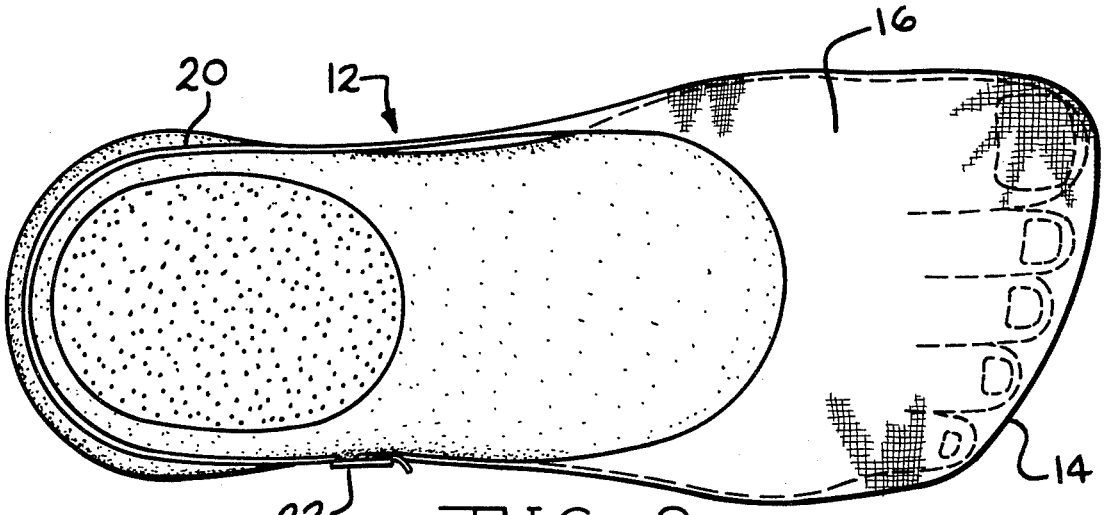
FIG. 2 is a top view of the foot and gymnastic footlet show in FIG. 1.
Figure 3:
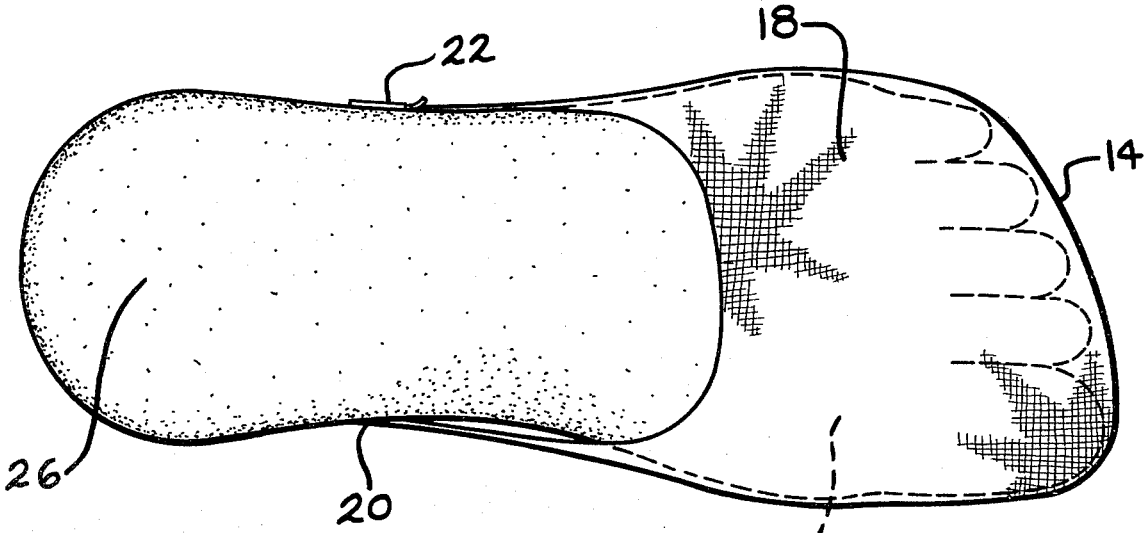
FIG. 3 is a bottom view of the foot and gymnastic footlet shown in FIG. 1.

Referring to FIGS. 1, 2, and 3, there is shown a gymnastic footlet 10 according to the present invention which is fitted on the right foot 12. The footlet 10 includes a front toe section 14 having a top portion 16 and a bottom portion 18. The toe section 14 is held in position on the forward end of the foot 12 by a securing strap 20. The strap 20 has one end attached to one side of the toe section, and an opposite end attached to the opposite side of the toe section. The strap 20 can include an adjusting means such as a buckle 22 for properly fitting the footlet 10 on the respective foot.

The footlet 10 is typically constructed of a material which will provide an area of reduced friction between the foot and the dance surface. This area of reduced friction is defined by the area on the bottom of the foot covered by the bottom portion 18. In accordance with the present invention, the bottom portion 18 of the toe section 14 extends rearwardly from the toes of the foot to cover the ball area of the foot, generally designated by reference numeral 24. Thus, when the footlet 10 is properly fitted on the foot 12, the ball area 24 is covered while the heel of the foot, generally designated by reference numeral 26, is uncovered.

A footlet having this type of construction can be of considerable assistance to both gymnasts and dancers in the execution of various dance steps. For example, the bottom portion 18 covers the ball area of the foot to provide an area of relatively low friction between the foot and the dance surface while the heel remains uncovered to provide an area of relatively high friction. Thus, the gymnasts or dancer can utilize the ball area of the feet to execute steps requiring low friction between the feet and the dance surface while the heels of the feet can be used to execute steps in which the feet are required to grip the dance surface.

The footlet 10 can typically be fabricated of terry cloth to provide a one piece construction. The footlet 10 can also be constructed of a soft leather or a similar synthetic material, in which case the securing strap 20 would be provided with adjusting means.

As previously stated, the choice of material or fabric used in the footlet of this construction will, to a large extent, be determined by the end use, taste and demands of the wearer. For example, a soft leather or pigskin bottom portion 18 will provide a higher friction surface than will a terry cloth bottom portion. The choice of materials used does not form a part of the instant invention which, because of its construction, affords the manufacturer a wide choice which determines the ultimate characteristic of the footlet.

In accordance with the provisions of the patent statutes, the principle and best mode of operation of the invention have been explained in what is considered to represent its best embodiment. However, it should be noted that the invention may be practiced otherwise than as specifically illustrated and described without departing from its spirit or scope of the attached claims.

I claim:

1. A footlet for gymnasts, dancers and the like for providing the wearer with a limited support surface having a coefficient of friction less than that of the wearer's foot and determined by the material of said footlet in the support area thereof, said footlet including a toe section adapted to fit over the bare foot of the wearer having a bottom portion and a top portion joined at their forward and lateral edges to form a pocket for receiving and generally conforming to the forward end of the wearer's foot with said bottom portion covering only the ball area and toes on the bottom of the foot to define said support surface, and a securing strap extending rearwardly around the heel of the wearer.

2. The footlet of claim 1 wherein said securing strap extends rearwardly from each side of said toe section intermediate the bottom and top portions.

* * * * *